US005707787A

United States Patent [19]

Kuwae et al.

[11] Patent Number: 5,707,787

[45] Date of Patent: *Jan. 13, 1998

[54] PROCESSING SOLUTION FOR SILVER HALIDE PHOTOGRAPHIC LIGHT-SENSITIVE MATERIALS

[75] Inventors: Kenji Kuwae; Yutaka Ueda, both of Hino, Japan

[73] Assignee: Konica Corporation, Tokyo, Japan

[ * ] Notice: The portion of the term of this patent subsequent to Dec. 17, 2013, has been disclaimed.

[21] Appl. No.: 105,308

[22] Filed: Aug. 11, 1993

Related U.S. Application Data

[63] Continuation-in-part of Ser. No. 912,312, Jul. 13, 1992.

[30] Foreign Application Priority Data

Sep. 11, 1991 [JP] Japan ..... 4-231900
Aug. 21, 1992 [JP] Japan ..... 4-222865

[51] Int. Cl.[6] ..... G03C 7/00; G03C 5/38; G03C 5/44; G03C 5/18

[52] U.S. Cl. ..... 430/393; 430/430; 430/451; 430/455; 430/460; 430/461; 430/488; 430/490; 430/491

[58] Field of Search ..... 430/393, 430, 430/451, 455, 461, 488, 490, 491

[56] References Cited

U.S. PATENT DOCUMENTS 5,316,898 5/1994 Ueda et al. ..... 430/461
5,580,705 12/1996 Ueda et al. ..... 430/430
5,585,226 12/1996 Strickland et al. ..... 430/430

FOREIGN PATENT DOCUMENTS 0532003 3/1993 European Pat. Off. .
1043137 9/1983 U.S.S.R. .

OTHER PUBLICATIONS

Major et al., *Chem. Zvesti.* 20 (6), pp. 414–422 (1966) and Chem. Abstract, vol. 65, 1966, Abstract No. 11738f.
J. Neal et al., *Inorg. Chem.* 7, (11), pp. 2405–2412 (1968).
G. Ueno, "Chelate Chemistry", vol. 5, Sect. 1, pp. 309, 311, 324 (translation).

*Primary Examiner*—Glenn A. Caldarola
*Assistant Examiner*—J. Pasterczyk
*Attorney, Agent, or Firm*—Frishauf, Holtz, Goodman, Langer & Chick, P.C.

[57] ABSTRACT

A processing solution for processing an exposed silver halide photographic light-sensitive material comprises a compound represented by the following formula (A):

Formula (A)

wherein $A_1$, $A_2$, $A_3$ and $A_4$ each represent —$COOM_1$, —OH, —$PO_3M_1M_2$ or —$CONH_2$ in which $M_1$ and $M_2$ each represent a hydrogen ion, an alkali metal ion or another cation; $R_1$, $R_2$, $R_3$ and $R_4$ each represent a hydrogen atom, a lower alkyl group or a hydroxyl group; $n_1$, $n_2$, $n_3$ and $n_4$ each represent an integer of 0, 1 or 2, provided that none of $R_1$, $R_2$, $R_3$ and $R_4$ are hydrogen atoms when $n_1+n_2=1$ and $n_3+n_4=1$; and X represents a substituted or unsubstituted alkylene group having 2 to 6 carbon atoms or —$(B_1O)m$-$B_2$— in which $B_1$ and $B_2$ each represent a substituted or unsubstituted alkylene group having 1 to 5 carbon atoms, and m is an integer of from 1 to 4.

7 Claims, No Drawings

PROCESSING SOLUTION FOR SILVER HALIDE PHOTOGRAPHIC LIGHT-SENSITIVE MATERIALS

This application is a continuation-in-part of application Ser. No. 07/912,312 filed Jul. 13, 1992 which was abandoned Dec. 17, 1993 as part of a 37 CFR 1.62 filing of divisional application Ser. No. 08/168,984 on Dec. 17, 1993.

FIELD OF THE INVENTION

The present invention relates to improvements in a processing solution for processing exposed silver halide photographic light-sensitive materials. More particularly, the present invention relates to a photographic processing solution for silver halide photographic light-sensitive materials containing a new photographic chelating agent for the purpose of sequestering metal ions which exert adverse effects or using the chelating agent as a bleaching agent.

BACKGROUND OF THE INVENTION

In general, exposed silver halide photographic light-sensitive materials need to be processed, for image formation, with various processing solutions including a developer and a fixer. Particularly, in the formation of color images, many more processes are required. Processing solutions used in such processes contain a variety of components; therefore, when water used for the preparation of the relevant solutions contains metal ions such as calcium, magnesium or iron ions, the components in the solution react with such metal ions to form precipitates or sludges, causing difficulties such as clogging of the filter mounted on an automatic processor and staining on light-sensitive material being processed due to adhesion of these deposits. Even when pure water is used in preparing these processing solutions, formation of precipitates or sludges in a processing bath cannot be completely prevented because these metal ions are dissolved from light-sensitive material being processed or brought from the preceding processing bath. Further, some of the components contained in the processing solutions have a problem that these are subject to oxidation or decomposition and lose their activities in the presence of the metal ions and eventually cause difficulties such as fogging and lowering in sensitivity.

In order to prevent such undesired effects on the processing solutions caused by the metal ions, there is proposed and practiced the addition of the so-called chelating agent for sequestering the metal ions to a photographic processing composition. Examples of such chelating agents include polyphosphates such as sodium hexametaphosphate proposed in British Pat. No. 520,593, alkylidene diphosphonic acids proposed in U.S. Pat. No. 3,214,454, and aminopolycarboxylic acids represented by aminopolymethylene phosphonic acids and ethylenediaminetetraacetic acid proposed in U.S. Pat. No. 3,201,246. However, various problems still remain unsolved in practical uses of such chelating agents. That is, the polyphosphates are low in capabilities of blocking metal ions, particularly poor in blocking heavy metal ions and therefore cannot be put into practical use.

The alkylidene diphosphonic acids have a problem of forming solid precipitates and thereby impairing automatic processors when a calcium ion and a sodium ion coexist at a certain concentration or above. The conventional aminopolycarboxylic acids represented by ethylenediaminetetraacetic acid and aminopolymethylenephosphonic acid represented by aminotrimethylenephosphonic acid, though high in metal ion blocking capabilities, have problems that when used in a color developer containing hydroxylamine, they decompose the hydroxylamine in the presence of the metal ion and thereby cause fogs on a light-sensitive material processed in the color developer, and that when used in a black-and-white developer, they accelerate oxidation and degrade storage stability of developing agents, which causes heavy fogs on a high-sensitivity photographic film.

As described above, the chelating agents proposed up to the present more or less have disadvantages and cannot necessarily produce satisfactory results when used in a photographic processing composition. Further, with the recent tendency to decrease the replenishing amount of photographic processing solutions due to socio-environmental requirements toward lower pollution as well as economical requirements toward lower processing costs, the amount of metal ions including a calcium ion, which are dissolved out while processing photographic light-sensitive materials and accumulated in the processing solutions, is increasing steadily.

In addition, less expensive lower grade materials are being used in photographic materials to reduce cost. This results in a further accumulation of metal ions in the photographic processing solutions.

Under the circumstances, it is hard for the existing techniques to suppress the undesired influence exerted by metal ions.

In recent years, the use of raw materials of good biodegradability is increasingly demanded for the purpose of environmental protection. However, ethylenediaminetetraacetic acid and diethylenetriaminepentaacetic acid, which have been used as chelating agents most widely, are known to be only slightly biodegradable and, in some regions, there is a movement afoot even to control the use of these compounds.

By the way, the above aminopolycarboxylic acids, or the above chelating agents, are widely used in large amounts, in the form of metal complex salts, in bleaches and bleach-fixers as bleaching agents to remove image silver. Examples of the metal complex salts of the above aminopolycarboxylic acids include a ferric complex salt of ethylenediaminetetraacetic acid, a ferric complex salt of 1,3-propylenediaminetetraacetic acid, and a ferric complex salt of diethylenetriaminepentaacetic acid.

Among these bleaching agents, the ferric complex salt of 1,3-propylenediaminetetraacetic acid have a high oxidizing power, so that this is used in bleaches particularly for rapid processing of high-sensitive silver halide color photographic light-sensitive materials. However, the ferric complex salt of 1,3-propylenediaminetetraacetic acid has a disadvantage attributable to the high oxidizing power; that is, this salt oxidizes a color developing agent brought from the preceding bath and enable it to form dyes through coupling with unreacted couplers in a light-sensitive material, causing the so-called bleach fogging.

The ferric complex salt of ethylenediaminetetraacetic acid, though inferior to the ferric complex salt of 1,3-polypylenediaminetetraacetic acid in oxidizing power, is widely used as a bleaching agent in the bleach-fixing process which carries out bleaching and fixing in a single bath, for purposes of simplifying the process and performing the processing rapidly. In a bleach-fixing bath where a bleaching agent or an oxidizing agent and a fixing agent (a thiosulfate ion) or a reducing material coexist, the oxidizing agent decomposes the thiosulfate ion to sulfur by oxidation. To prevent the thiosulfate ion from being oxidized to sulfur, a bleach-fixer usually contains a sulfite ion as a preservative.

However, when ferric complex salt of ethylenediaminetetraacetic acid is used in a bleach-fixing bath, the complex salt always keeps the ferric state in the bath because of very fast oxidation speed from the ferrous state to the ferric state, and continues decomposing the sulfite ion used as a preservative. As a result, the oxidation of the thiosulfate ion to sulfur is accelerated, lowering the preservability of the processing solution.

As means to solve the problem, Japanese Pat. O.P.I. Pub. Nos. 149358/1984, 151154/1984 and 166977/1984 disclose techniques which use ferric complex salt of diethylenetriaminepentaacetic acid.

Bleach-fixers based on these techniques are certainly superior in solution preservability to those using a ferric complex salt of ethylenediaminetetraacetic acid. But, when color paper is processed using a ferric complex salt of diethylenetriaminepentaacetic acid, stains are often observed at the edges of the paper, and a problem called edge penetration is liable to occur.

Further, a readily biodegradable material is demanded in the recent tendency toward global environmental protection. However, there is a movement in some regions even to control the use of the ferric complex salt of ethylenediaminetetraacetic acid and the ferric complex salt of diethylenetriaminepentaacetic acid for their very poor biodegradability.

Under such conditions, there is an eager desire for a bleach excellent in rapid desilverizing capability and free from bleach fogging as well as for a bleach-fixer excellent in rapid desilverizing capability, high in solution preservability, free from stains in the edge portions and excellent in biodegradability.

SUMMARY OF THE INVENTION

Accordingly, a first object of the present invention is to provide a processing solution with bleaching capability for a silver halide photographic light-sensitive material which is excellent in rapid desilverizing capability, less in fogging in edge portions and high in solution preservability.

A second object of the present invention is to provide a processing solution for a silver halide photographic light-sensitive material which can give a stable processing bath free from formation of precipitates or sludges caused by metal ions present therein.

A third object of the present invention is to provide a processing solution for a silver halide photographic light-sensitive material which allows stable processing over a long period and causes no filter clogging when used in processing with an automatic processor.

A fourth object of the present invention is to provide a processing solution for a silver halide photographic light-sensitive material which is excellent in biodegradability and thereby fits for global environmental protection.

Other objects of the present invention will become apparent from the following description.

The above objects of the invention are achieved by photographic processing solutions defined by the following items (1), (2), (3), (4) and (5), respectively:

(1) A processing solution for silver halide photographic light-sensitive materials containing at least one of the compounds represented by the following formula (A):

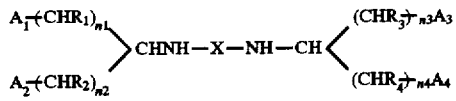

Formula (A)

wherein $A_1$ to $A_4$ each represent —COOM$_1$, —OH, —PO$_3$M$_1$M$_2$ or —CONH$_2$ and may be the same or different from each other; $M_1$ and $M_2$ each represent a hydrogen ion, an alkali metal ion or another cation; $n_1$ to $n_4$ each represent an integer of 0, 1 or 2; $R_1$ to $R_4$ each represent a hydrogen atom, a lower alkyl group or a hydroxyl group, provided that none of $R_1$ to $R_4$ are hydrogen atoms when $n_1+n_2=1$ and $n_3+n_4=1$; X represents a substituted or unsubstituted alkylene group having 2 to 6 carbon atoms or —($B_1$O)m-$B_2$—, in which m represents an integer of 1 to 4 and $B_1$ and $B_2$, which may be the same or different, each represent a substituted or unsubstituted alkylene group of 1 to 5 carbon atoms.

(2) A processing solution for silver halide photographic light-sensitive materials as defined in item (1), wherein the processing solution for silver halide photographic light-sensitive materials is a bleach or a bleach-fixer containing a ferric complex salt of the foregoing compound.

(3) A processing solution for silver halide photographic light-sensitive materials as defined in item (1), wherein the processing solution for silver halide photographic light-sensitive materials is a developer.

(4) A processing solution for silver halide photographic light-sensitive materials as defined in item (1), wherein the processing solution for silver halide photographic light-sensitive materials is a fixer.

(5) A processing solution for silver halide photographic light-sensitive materials as defined in item (1), wherein the processing solution for silver halide photographic light-sensitive materials is a stabilizer.

Next the compound represented by formula [A] is described.

In the formula, $A_1$ to $A_4$ may be the same or different and each represent —COOM$_1$, —OH, —PO$_3$M$_1$M$_2$ or —CONH$_2$. $M_1$ and $M_2$ each represent a hydrogen ion, an alkali metal ion such as a sodium, potassium or lithium ion, or another cation such as an ammonium, methylammonium or tetramethylammonium ion.

$n_1$ to $n_4$ each represent an integer of 0 to 2 and may be the same or different, but preferably $n_1$ is zero and $n_3$ is zero. $R_1$ to $R_4$, which may be the same or different, each represent a hydrogen atom, a lower alkyl group or a hydroxyl group, preferably a hydrogen atom. But none of $R_1$ to $R_4$ are hydrogen atoms when $n_1+n_2=1$ and $n_3+n_4=1$.

X represents a substituted or unsubstituted alkylene group of 2 to 6 carbon atoms or —($B_1$O)m-$B_2$—, in which $B_1$ and $B_2$ may be the same or different and each represent a substituted or unsubstituted alkylene group of 1 to 5 carbon atoms. The alkylene group represented by X includes an ethylene, trimethylene and tetramethylene group; the alkylene group represented by $B_1$ or $B_2$ includes a methylene, ethylene and trimethylene group.

The substituent of the alkylene group represented by X, $B_1$ or $B_2$ includes a hydroxyl group and an alkyl group of 1 to 3 carbon atoms such as a methyl or ethyl group. m is an integer of 1 to 4, and preferably 1 to 2.

The following are preferred examples of the compound represented by formula (A), but the scope of the invention is not limited to them.

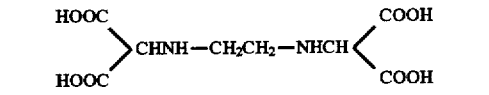
A-1

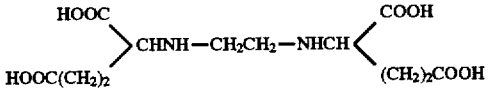
A-2

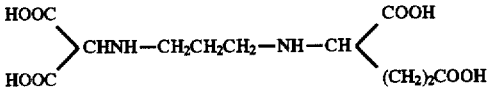
A-3

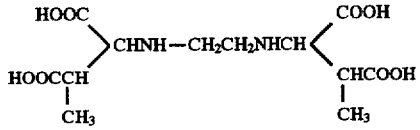
A-4

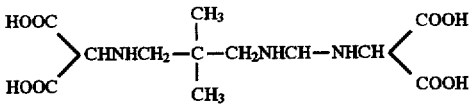
A-5

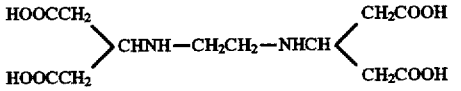
A-6

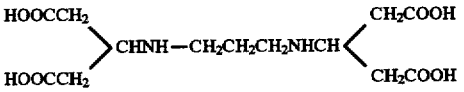
A-7

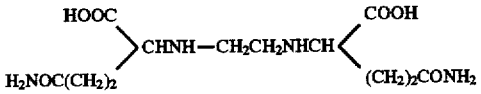
A-8

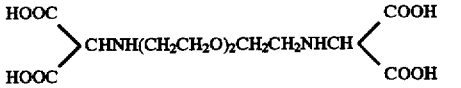
A-9

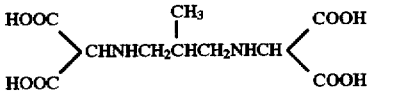
A-10

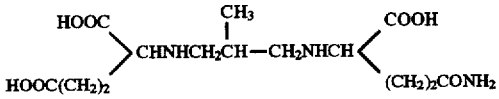
A-11

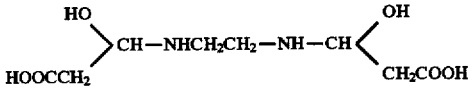
A-12

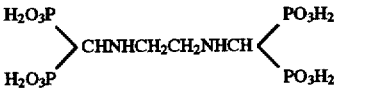
A-13

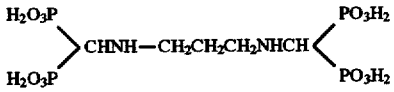
A-14

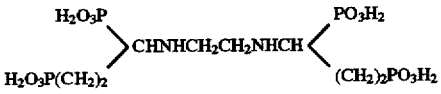
A-15

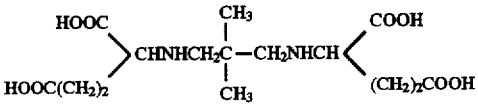
A-16

-continued

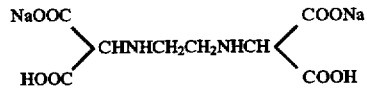
A-17

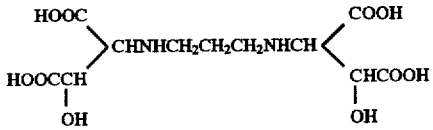
A-18

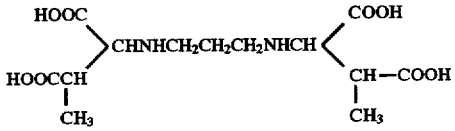
A-19

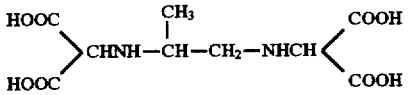
A-20

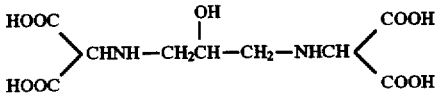
A-21

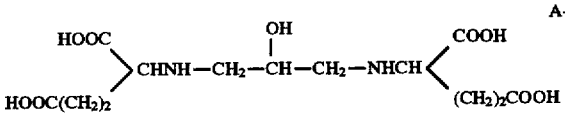
A-22

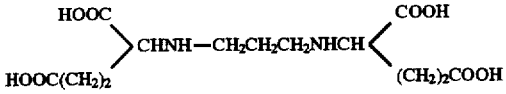
A-23

Among the above compounds, particularly preferred ones are compounds A-1, A-2, A-4 and A-23.

The compounds expressed by formula (A) can be synthesized in generally known manners.

Method for synthesizing "Exemplified compound A-1"

Exemplified compound A-1 was synthesized by the method described in Bulletin of the Chemical Society of Japan, Vol. 46,844 (1973).

Method for synthesizing "Exemplified compound A-2"

Exemplified compound A-2 was synthesized by the following method with reference to Inorganic Chemistry Vol. 7,2405 (1968).

To 1.8 l of water was added 374 g of L-Glutamic acid monosodium salt monohydrate to obtain a solution, and then 80 g of sodium hydroxide was added to the solution under the condition of cooling with ice. Then, 106 g of sodium carbonate and 1 l of 95% ethanol were added to the solution. The mixed solution thus obtained was then subjected to heating reflux, and 225 g of 1,2-dibromoethane was added dropweise to the mixed solution in 4 hours under vigorous stirring. Twenty hours after addition of 1,2-dibromoethane, the mixed solution was cooled down to 5° C. and was adjusted to pH 3.0 by adding 6N hydrochloric acid thereto. The precipitate thus obtained was dissolved in an aqueous solution of sodium hydroxide and adjusted to pH 3.0 by adding 6N hydrochloric acid to precipitate crystal to be purified. The crystal was washed with water, ethanol and ether and then was dried for 5 hours at 60° C. under reduced pressure. The yield was 96 g (30%), and the structure thereof was checked by means of NMR, IR and mass-spectra.

Other exemplified compounds can be synthesized in the same method as in the foregoing.

Firstly, processing solutions having bleaching capability, namely bleach and bleach-fixer of the invention, are described.

In the embodiment of the invention, it is particularly preferred that the bleach or the bleach-fixer contain the compound represented by formula (A) in the form of a ferric complex salt.

The addition amount of the compound to the processing solution having bleaching capability is preferably 0.05 to 2.0 moles per liter, more preferably 0.1 to 1.0 mole per liter.

The bleach or the bleach-fixer according to the invention may contain ferric complex salts of the following compounds besides ferric complex salts of the compound represented by formula (A):

(A'-1) Ethylenediaminetetraacetic acid
(A'-2) Trans-1,2-cyclohexanediaminetetraacetic acid
(A'-3) Dihydroxyethylglycinic acid
(A'-4) Ethylenediamine-tetrakismethylene-phosphonic acid
(A'-5) Nitrilo-trismethylene-phosphonic acid
(A'-6) Diethylenetriamine-pentakismethylene-phosphonic acid
(A'-7) Diethylenetriaminepentaacetic acid
(A'-8) Ethylenediamine-di-o-hydroxyphenylacetic acid
(A'-9) Hydroxyethyl-ethylenediaminetriacetic acid
(A'-10) Ethylenediaminepropionic acid
(A'-11) Ethylenediaminediacetic acid
(A'-12) Hydroxyethyliminodiacetic acid
(A'-13) Nitrilotriacetic acid
(A'-14) Nitrilotripropionic acid
(A'-15) Triethylenetetraminehexaacetic acid
(A'-16) Ethylenediaminetetrapropionic acid These organic acid ferric complex salts are used in an amount of preferably 0.05 to 2.0 moles, more preferably 0.1 to 1.5 mole per liter of bleach or bleach-fixer.

The rapid processing capability of the bleach or the bleach-fixer can be enhanced by adding thereto at least one of the compounds selected from imidazole and its derivatives disclosed in Japanese Pat. O.P.I. Pub. No. 295258/1989, the compounds represented by formula (I) to (IX) described in the same specification and the exemplified compounds thereof.

In addition to the above accelerators, there may also be used the compounds exemplified on pages 51 to 115 of Japanese Pat. O.P.I. Pub. No.123459/1987, the compounds exemplified on pages 22 to 25 of Japanese Pat. O.P.I. Pub. No. 17445/1988 and the compounds disclosed in Japanese Pat. O.P.I. Pub. Nos. 95630/1978, 28426/1978.

The bleach and the bleach-fixer are used at temperatures of 20° to 50° C., preferably 25° to 45° C.

The pH of the bleach is preferably not more than 6.0, more preferably within the range of 1.0 to 5.5. The pH of the bleach-fixer is preferably within the range of 5.0 to 9.0, more preferably 6.0 to 8.5. These pH values are those at which a silver halide photographic light-sensitive material is processed and are clearly distinguished from those of the socalled replenishers.

The bleacher or the bleach-fixer may contain halides such as ammonium bromide, potassium bromide, sodium bromide, various optical whitening agents, defoamers and surfactants besides the above compounds.

The replenishing amount of the bleach or the bleach-fixer is preferably not more than 500 ml, more preferably 20 to 400 ml and most preferably 40 to 350 ml per square meter of light-sensitive material. The effect of the invention is brought out more apparently as the replenishing amount decreases.

In embodying the invention, air or oxygen may be blown into a processing bath or a replenisher tank of the bleach or the bleach-fixer, if desired, for enhancing the activities of these processing solutions. Addition of suitable oxidizing agents, such as hydrogen peroxide, bromates or persulfates, is also effective as an alternative measure.

As fixing agents used in the bleach-fixer of the invention, thiocyanates and thiosulfates are preferred. The content of thiocyanates is usually not less than 0.1 mol/l and, in processing color negative films, it is preferably not less than 0.5 mol/l and more preferably not less than 1.0 mol/l. The content of thiosulfates is usually not less than 0.2 mol/l and, in processing color negative films, it is preferably not less than 0.5 mol/l.

In addition to these fixing agents, the bleach-fixer of the invention may contain, singly or in combination of two or more types, pH buffers comprising a variety of salts. Further, it is preferred that rehalogenating agents including alkali halides and ammonium halides such as potassium bromide, sodium bromide, sodium chloride and ammonium bromide be contained therein in large amounts. There may also be contained proper amounts of alkylamines and polyethylene oxides which are usually used in a bleach-fixer.

Further, silver may be recovered by the known method from the bleach-fixer of the invention.

In a preferred embodiment of the invention, the bleach-fixer contains a compound represented by the following formula (FA) described on page 56 of Japanese Pat. O.P.I. Pub. No. 295258/1989 or an exemplified compound thereof. Addition of this compound not only better brings out the effect of the invention, but also effectively controls formation of sludges in a processing solution with fixing capability when a small amount of light-sensitive materials are processed over a long time.

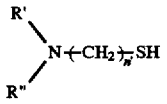

The compounds expressed by formula [FA] in the above specification can be synthesized by general methods described, for example, in U.S. Pat. Nos. 3,335,161 and 3,260,718. The compounds represented by formula (FA) may be used singly or in combination of two or more types.

Favorable results can be obtained when these compounds are added in an amount of 0.1 to 200 g per liter of processing solution.

The processing times with the bleach and the bleach-fixer can be arbitrarily selected; but, these are preferably not more than 3 minutes and 30 seconds, more preferably 10 seconds to 2 minutes and 20 seconds, and most preferably 20 seconds to 1 minute and 20 seconds, respectively. The processing time with the bleach-fixer is preferably not more than 4 minutes, more preferably within the range of 10 seconds to 2 minutes and 20 seconds.

When the amount of ammonium ions contained in the processing solution of the invention for silver halide color photographic light-sensitive materials is not more than 50 mol % of the total cations contained therein, the effect of the invention is well brought out and, further, smelling can be minimized. Accordingly, this is one of the preferable embodiments of the invention. Much better results can be obtained when the amount of ammonium ions is not more than 30 mol %, especially not more than 10 mol %.

Next, an explanation is given on the processing solutions of the invention other than the bleach or the bleach-fixer.

When the processing solution of the invention is a processing solution other than the bleach or the bleach-fixer, favorable results can be obtained when the compound of formula (A) are added in an amount of 0.1 to 50 g, preferably 0.5 to 10 g per liter of processing solution. At the incorporation, two or more compounds of formula (A) may be combined, or these may be used jointly with other types of chelating agents. These may be incorporated into the processing solution together with other components at the time of preparing the processing solution, or these may be incorporated, together with other components, into a powdery kit without being dissolved, or into a kit of concentrated solutions.

Besides bleach or bleach-fixer, the photographic processing solution according to the invention can be applied to any other processing solution for silver halide photographic light-sensitive materials. Examples of such processing solution include usual black-and-white developer, infection developer for lith films, color developer, fixer, stopping solution, a hardening solution, stabilizer, fogging solution and a toning solution, but the embodiment of the invention is not limited to them. The developers, color developer, fixer, stopping solution, hardening solution, stabilizer, fogging solution and toning solution above-described contain a developing agent, a color developing agent, a fixing agent, a stopping agent, a hardening agent, a stabilizing agent, a fogging agent and a toning agent, respectively. The processing solution according to the invention can be used in processing all types of silver halide photographic light-sensitive materials including color films, color photographic paper, black-and-white films for popular uses, X-ray photographic films, lith films for printing, and microfilms.

EXAMPLES

The invention is hereunder described in detail with examples, but the scope of the invention is by no means limited to these examples.

Example 1

Preparation of Silver Halide Color Photographic Light-sensitive Material (Color Paper)

A multilayer silver halide color photographic light-sensitive material was prepared by forming the following component layers on a paper support laminated with polyethylene on one side and with titanium-oxide-containing polyethylene on the first layer of the other side. The coating solutions were prepared as follows:

Coating Solution for 1st Layer

In 6.67 g of high boiling solvent DNP and 60 ml of ethyl acetate were dissolved 26.7 g of yellow coupler Y-1, 100 g of dye image stabilizer ST-1, 6.67 g of dye image stabilizer ST-2 and 0.67 g of additive HQ-1. The resultant solution was dispersed in 220 ml of 10% aqueous gelatin solution containing 7 ml of 20% surfactant SU-1 with a supersonic homogenizer, so that a yellow coupler dispersion was prepared. The dispersion was mixed with a blue-sensitive silver halide emulsion (silver content: 9.5 g) prepared under the conditions described later. A coating solution for 1st layer was so obtained.

Coating Solutions for 2nd to 7th Layers

Coating solutions for 2nd to 7th layers were prepared in a similar manner as above.

Besides the above compounds, hardener H-1 was used in the nd and 4th layers and hardener H-2 in the 7th layer. As coating aides, surfactants SU-2 and SU-3 were employed to adjust the surface tension.

TABLE 1

| Layer | Component | Coating Weight ($g/m^2$) |
|---|---|---|
| 7th layer (Protective layer) | gelatin | 1.0 |
| 6th layer (UV-absorbing layer) | gelatin | 0.35 |
| | UV-absorber UV-1 | 0.10 |
| | UV-absorber UV-2 | 0.04 |
| | UV-absorber UV-3 | 0.18 |
| | antistain agent HQ-1 | 0.01 |
| | DNP | 0.18 |
| | PVP | 0.03 |
| | anti-irradiation dye AI-2 | 0.02 |
| 5th layer (Red-sensitive layer) | gelatin | 1.21 |
| | red-sensitive silver chlorobromide emulsion (EmC) | |
| | silver equivalent | 0.19 |
| | cyan coupler C-1 | 0.20 |
| | cyan coupler C-2 | 0.25 |
| | dye image stabilizer ST-1 | 0.20 |
| | antistain agent HQ-1 | 0.01 |
| | HBS-1 | 0.20 |
| | DOP | 0.20 |
| 4th layer (UV-absorbing layer) | gelatin | 0.90 |
| | UV-absorber UV-1 | 0.28 |
| | UV-absorber UV-2 | 0.08 |
| | UV-absorber UV-3 | 0.38 |
| | antistain agent HQ-1 | 0.03 |
| | DNP | 0.35 |

TABLE 2

| Layer | Component | Coating Weight ($g/m^2$) |
|---|---|---|
| 3rd layer (Green-sensitive layer) | gelatin | 1.40 |
| | green-sensitive silver chlorobromide emulsion (EmB) | |
| | silver equivalent | 0.15 |
| | magenta coupler M-C | 0.32 |
| | dye image stabilizer ST-3 | 0.15 |
| | dye image stabilizer ST-4 | 0.15 |
| | dye image stabilizer ST-5 | 0.15 |
| | DNP | 0.20 |
| | anti-irradiation dye AI-1 | 0.02 |
| 2nd layer (Intermediate layer) | gelatin | 1.20 |
| | antistain agent HQ-2 | 0.12 |
| | DIDP | 0.15 |
| 1st layer (Blue-sensitive layer) | gelatin | 1.20 |
| | blue-sensitive silver chlorobromide emulsion (EmA) | |
| | silver equivalent | 0.25 |
| | yellow coupler Y-1 | 0.82 |
| | dye image stabilizer ST-1 | 0.30 |
| | dye image stabilizer ST-2 | 0.20 |
| | antistain agent HQ-1 | 0.02 |
| | anti-irradiation dye AI-3 | 0.02 |
| | DNP | 0.20 |
| Support | polyethylene laminated paper | |

Y-1
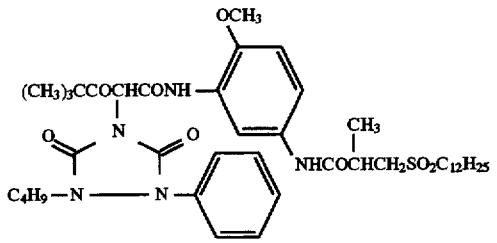
M-C
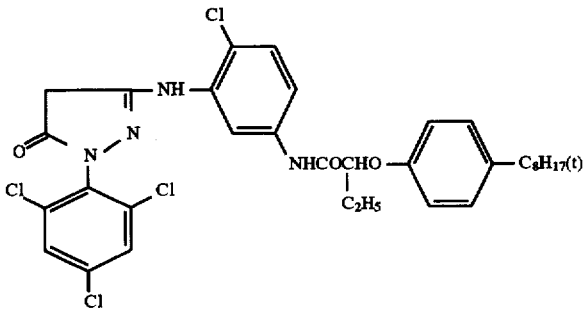
C-1
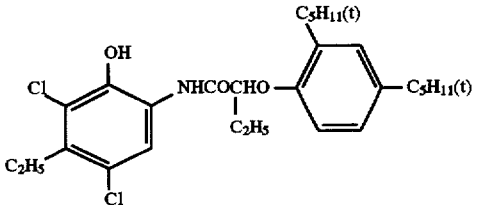
C-2
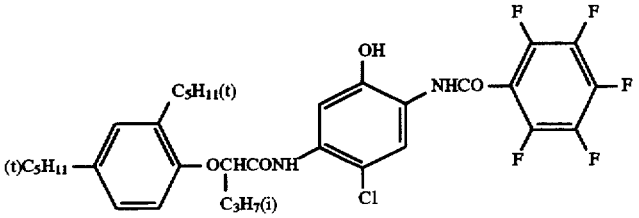
ST-1
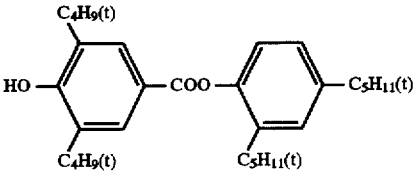
ST-2
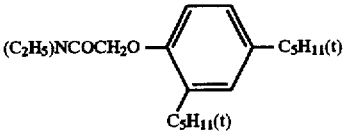
ST-3
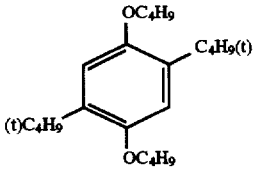
ST-4
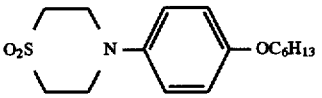
ST-5
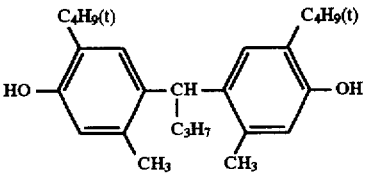
UV-1
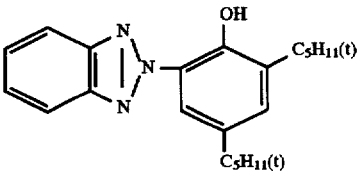

-continued

UV-2

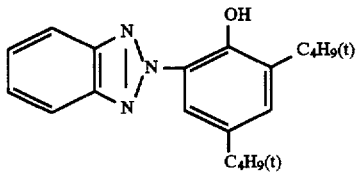

UV-3

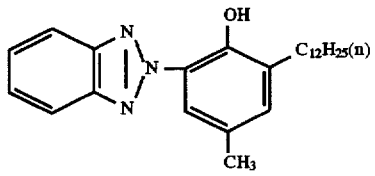

DOP: dioctyl phthalate

DNP: dinonyl phthalate

DIDP: diisodecyl phthalate

PVP: polyvinylpyrrolidone

HQ-1

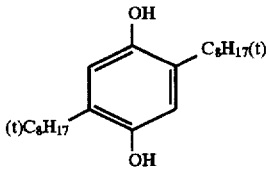

HQ-2

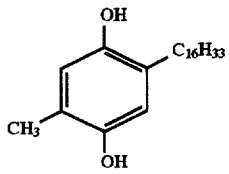

HBS-1

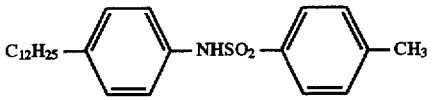

AI-1

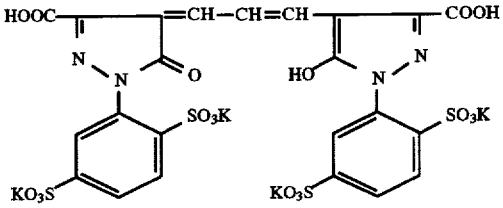

AI-2

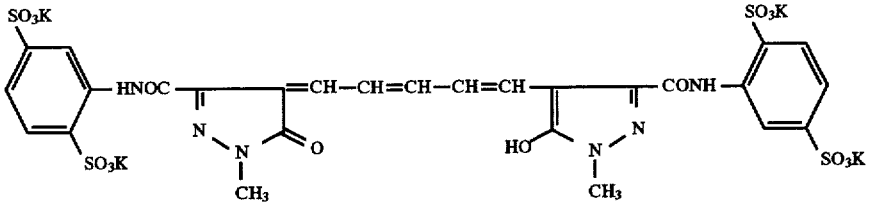

AI-3

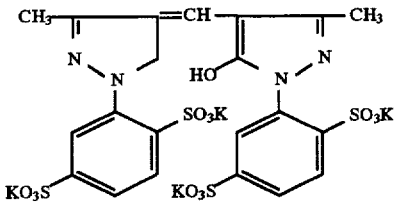

SU-1

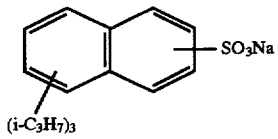

SU-2

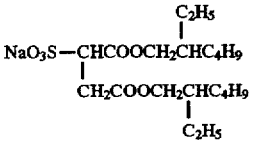

SU-3

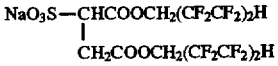

H-1

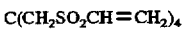

H-2

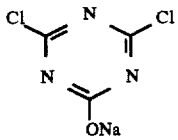

Preparation of Blue-sensitive Silver Halide Emulsion

To 1000 ml of 2% aqueous gelatin solution kept at 40° C. were simultaneously added the following solutions A and B in minutes with the reaction mixture controlled at pAg 6.5 and pH 3.0. Then, the following solutions C and D were added thereto over a 180-minute period, while controlling the pAg at 7.3 and the pH at 5.5.

The control of the pAg was performed by the procedure described in Japanese Pat. O.P.I. Pub. No. 45437/1984, and the pH was controlled with sulfuric acid or an aqueous solution of sodium hydroxide.

| Solution A | |
|---|---|
| Sodium chloride | 3.42 g |
| Potassium bromide | 0.03 g |
| Water was added to | 200 ml |
| **Solution B** | |
| Silver nitrate | 10 g |
| Water was added to | 200 ml |

-continued

| | |
|---|---|
| Solution C | |
| Sodium chloride | 102.7 g |
| Potassium bromide | 1.0 g |
| Water was added to | 600 ml |
| Solution D | |
| Silver nitrate | 300 g |
| Water was added to | 600 ml |

After completing the addition, desalting was carried out using 5% aqueous solution of Demol N made by Kao-Atlas Co. and 20% aqueous solution of magnesium sulfate. Subsequently, the product was dispersed in an aqueous solution of gelatin. Emulsion EMP-1 thus obtained comprises monodispersed cubic grains having an average grain size of 0.85 μm, a coefficient of variation of grain size distribution of 7% and a silver chloride content of 99.5 mol %.

Emulsion EMP-1 was then chemically ripened for 90 minutes at 50° C. in the presence of the following compounds to obtain a blue-sensitive silver halide emulsion (Em-A).

| | |
|---|---|
| Sodium thiosulfate | 0.8 mg/mol AgX |
| Chloroauric acid | 0.5 mg/mol AgX |
| Stabilizer STAB-1 | $5.8 \times 10^{-4}$ mol/mol AgX |
| Sensitizing dye BS-1 | $4.1 \times 10^{-4}$ mol/mol AgX |
| Sensitizing dye BS-2 | $1.2 \times 10^{-4}$ mol/mol AgX |

Preparation of Green-sensitive Silver Halide Emulsion

| | |
|---|---|
| Sodium thiosulfate | 1.5 mg/mol AgX |
| Chloroauric acid | 1.0 mg/mol AgX |
| Stabilizer STAB-1 | $5.8 \times 10^{-4}$ mol/mol AgX |
| Sensitizing dye GS-1 | $4.1 \times 10^{-4}$ mol/mol AgX |

Preparation of Red-sensitive Silver Halide Emulsion

Emulsion EMP-3 comprising monodispersed cubic grains having an average grain size of 0.50 μm, a coefficient of variation of grain size distribution of 8% and a silver chloride content of 99.5 mol % was prepared in the same manner as in emulsion EMP-1, except that the addition time of solutions A and B as well as that of solutions C and D were changed.

Emulsion EMP-3 was then chemically ripened at 60° C. for 90 minutes using the following compounds, so that a red-sensitive silver halide emulsion (Em-C) was obtained.

| | |
|---|---|
| Sodium thiosulfate | 1.8 mg/mol AgX |
| Chloroauric acid | 2.0 mg/mol AgX |
| Stabilizer STAB-1 | $5.8 \times 10^{-4}$ mol/mol AgX |
| Sensitizing dye RS-1 | $4.1 \times 10^{-4}$ mol/mol AgX |

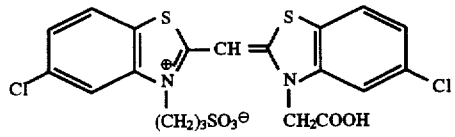
BS-1

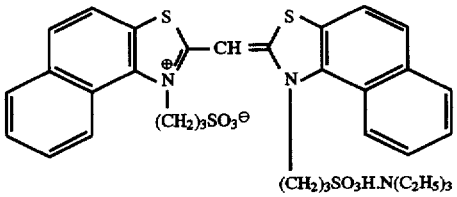
BS-2

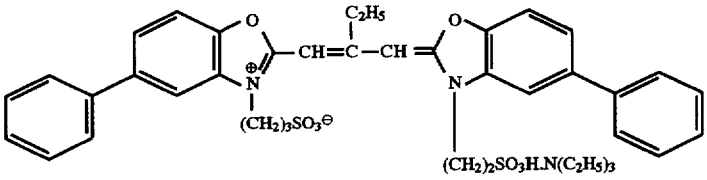
GS-1

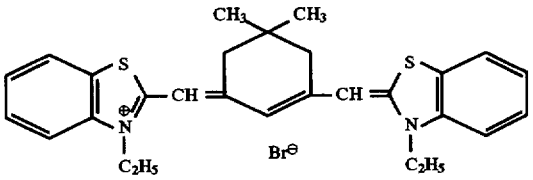
RS-1

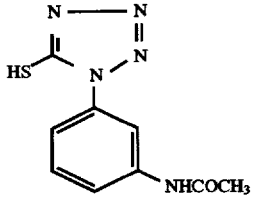
STAB-1

Emulsion EMP-2 comprising monodispersed cubic grains having an average grain size of 0.43 μm, a coefficient of variation of grain size distribution of 8% and a silver chloride content of 99.5 mol % was prepared in the same manner as in emulsion EMP-1, except that the addition time of solutions A and B as well as that of solutions C and D were changed.

Emulsion EMP-2 was chemically ripened at 55° C. for 120 minutes using the following compounds. A green-sensitive silver halide emulsion (Em-B) was so prepared.

This light-sensitive material sample was exposed in the usual manner and then processed using the following processes and processing solutions.

| Process | Temperature | Time | Replenishing Amount |
|---|---|---|---|
| Color developing | 35.0 + 0.3° C. | 45 sec | 162 ml/m² |
| Bleach-fixing | 35.0 + 0.5° C. | 45 sec | 100 ml/m² |
| Stabilizing | 30–34° C. | 90 sec | 248 ml/m² |

-continued

| | | |
|---|---|---|
| (3-tank cascade mode) | | |
| Drying | 60–80° C. | 30 sec |

Color Developer

| | |
|---|---|
| Triethanolamine | 10.0 g |
| Ethylene glycol | 6.0 g |
| N, N-Diethylhydroxylamine | 3.6 g |
| Disodium 2,2'-hydroxyimino-bis-ethanesulfonate | 5.0 g |
| Potassium bromide | 20 mg |
| Potassium chloride | 3.0 g |
| Diethylenetriaminepentaacetic acid | 5.0 g |
| Potassium sulfite | $5.0 \times 10^{-4}$ mol |
| Color developing agent CD-3 (3-methyl-4-amino-N-ethyl-N-(β-methanesulfonamidoethyl)-aniline sequisulfate monohydrate) | 5.5 g |
| Potassium carbonate | 25.0 g |
| Potassium hydrogencarbonate | 5.0 g |

Water was added to 1 liter, and the pH was adjusted to 10.10 with potassium hydroxide or sulfuric acid.

Color Developing Replenisher

| | |
|---|---|
| Triethanolamine | 14.0 g |
| Ethyiene glycol | 8.0 g |
| N.N-Diethylhydroxylamine | 5.0 g |
| Disodium 2.2'-hydroxyimino-bis-ethanesulfonate | 7.5 g |
| Potassium bromide | 8 mg |
| Potassium chloride | 0.3 g |
| Diethylenetriaminepentaacetic acid | 7.5 g |
| Potassium sulfite | $7.0 \times 10^{-4}$ mol |
| Color developing agent CD-3 | 8 g |
| Potassium carbonate | 30 g |
| Potassium hydrogencarbonate | 1 g |

Water was added to 1 liter, and the pH was adjusted to 10.40 with potassium hydroxide or sulfuric acid.

Bleach fixer

| | |
|---|---|
| Water | 600 ml |
| Organic acid ferric complex salt (see Tables 3 and 4) | 0.15 mol |
| Thiosulfate | 0.55 mol |
| Sulfite | 0.20 mol |
| 1,3-propanediaminetetraacetic acid | 2 g |

The pH was adjusted to 7.0 with aqueous ammonia, potassium hydroxide or acetic acid, and then the total volume was made up to 1 liter.

In preparing the bleach-fixer, the proportion of ammonium ions (mol %) was adjusted as shown in Tables 3 and 4 by controlling the amounts of ammonium salts and potassium salts of the above additives.

Bleach-fixing Replenisher

Each bleach-fixer component was used at a concentration 1.25 times that in the bleach-fixer to obtain a bleach-fixing replenisher. The pH was adjusted to 5.8.

Stabilizer and Stabilizing Replenisher

| | |
|---|---|
| O-Phenylphenol | 0.1 g |
| MST made by Ciba-Geigy AG | 1.0 g |
| $ZnSO_4.7H_2O$ | 0.1 g |
| Ammonium sulfite (40% sol.) | 5.0 ml |
| 1-Hydroxyethylidene-1,1-diphosphonic acid (60% sol.) | 3.0 g |
| Ethylenediaminetetraacetic acid | 1.5 g |

The pH was adjusted to 7.8 with aqueous ammonia or sulfuric acid, and water was added to 1 liter.

A continuous processing was carried out using the color paper and the processing solutions prepared as above.

First, an automatic processor was filled with the above color developing tank solution, bleach-fixing tank solution and stabilizing tank solution, and then the color paper was processed while the above color developing replenisher, bleach-fixing replenisher and stabilizing replenisher were replenished at 3-minute intervals through constant delivery pumps.

The continuous processing was run till the volume of the bleach-fixing replenisher fed to the bleach-fixing tank reached three times the capacity of the bleach-fixing tank (3R). The term "1 R" which will appear later means that the bleach-fixing replenisher is replenished up to a volume equal to the capacity of the bleach-fixing tank.

After the continuous processing, the exposed portion of the color paper was divided into two portions; the one portion was used to measure the residual amount of silver by fluorescent X-ray analysis. Further, the processed color paper was checked for staining at the edge portion. In addition, the bleach-fixing bath after the continuous processing was visually examined if there were formed sulfides. The evaluation results are shown in Tables 3 and 4.

In Tables 3 and 4, the alphabetical letters in the column of sulfide formation have the following meanings:

A: no sulfide is found.

B: a very slight floating matter is found on the liquid surface.

C: sulfides are found slightly.

D: sulfides are found apparently.

E: much sulfides are found.

The alphabetical letters in the column of edge staining have the following meanings:

A: no edge staining is found.

B: edge staining is found very slightly.

C: edge staining is found slightly.

D: edge staining is found at a level to become a problem certainly.

E: heavy edge staining is found.

TABLE 3

| Experiment No. | Organic Acid Ferric Complex Salt | Proprotion of Ammonium Ions to Total Cations in Bleach-fixer (mol %) | Amount of Residual Silver (mg/100 cm²) | Edge Staining | Sulfide Formation | Remarks |
|---|---|---|---|---|---|---|
| 1-1 | EDTA.Fe | 100 | 0.7 | C | D | comparison |
| 1-2 | EDTA.Fe | 60 | 0.8 | C | D | comparison |
| 1-3 | EDTA.Fe | 50 | 0.9 | C | D | comparison |
| 1-4 | EDTA.Fe | 30 | 0.9 | B | D | comparison |

TABLE 3-continued

| Experiment No. | Organic Acid Ferric Complex Salt | Proprotion of Ammonium Ions to Total Cations in Bleach-fixer (mol %) | Amount of Residual Silver (mg/100 cm$^2$) | Edge Staining | Sulfide Formation | Remarks |
|---|---|---|---|---|---|---|
| 1-5 | EDTA.Fe | 10 | 1.0 | B | D | comparison |
| 1-6 | EDTA.Fe | 0 | 1.1 | B | D | comparison |
| 1-7 | PDTA.Fe | 100 | 1.8 | C | E | comparison |
| 1-8 | PDTA.Fe | 60 | 1.8 | C | E | comparison |
| 1-9 | PDTA.Fe | 50 | 1.9 | B | E | comparison |
| 1-10 | PDTA.Fe | 30 | 1.9 | B | E | comparison |
| 1-11 | PDTA.Fe | 10 | 2.0 | B | E | comparison |
| 1-12 | PDTA.Fe | 0 | 2.1 | B | E | comparison |
| 1-13 | DTPA.Fe | 100 | 0 | E | B | comparison |
| 1-14 | DTPA.Fe | 60 | 0 | E | B | comparison |
| 1-15 | DTPA.Fe | 50 | 0.1 | E | B | comparison |
| 1-16 | DTPA.Fe | 30 | 0.1 | E | B | comparison |
| 1-17 | DTPA.Fe | 10 | 0.1 | D | B | comparison |
| 1-18 | DTPA.Fe | 0 | 0.2 | D | B | comparison |
| 1-19 | NTA.Fe | 100 | 1.2 | C | D | comparison |
| 1-20 | NTA.Fe | 60 | 1.3 | C | D | comparison |
| 1-21 | NTA.Fe | 50 | 1.4 | B | D | comparison |
| 1-22 | NTA.Fe | 30 | 1.4 | B | D | comparison |
| 1-23 | NTA.Fe | 10 | 1.5 | B | D | comparison |
| 1-24 | NTA.Fe | 0 | 1.7 | B | D | comparison |

TABLE 4

| Experiment No. | Organic Acid Ferric Complex Salt | Proprotion of Ammonium Ions to Total Cations in Bleach-fixer (mol %) | Amount of Residual Silver (mg/100 cm$^2$) | Edge Staining | Sulfide Formation | Remarks |
|---|---|---|---|---|---|---|
| 1-25 | (A-1).Fe | 100 | 0 | C | B | invention |
| 1-26 | (A-1).Fe | 60 | 0 | C | B | invention |
| 1-27 | (A-1).Fe | 50 | 0 | B | A | invention |
| 1-28 | (A-1).Fe | 30 | 0 | B | A | invention |
| 1-29 | (A-1).Fe | 10 | 0.1 | A | A | invention |
| 1-30 | (A-1).Fe | 0 | 0.1 | A | A | invention |
| 1-31 | (A-2).Fe | 100 | 0 | C | B | invention |
| 1-32 | (A-2).Fe | 60 | 0 | C | B | invention |
| 1-33 | (A-2).Fe | 50 | 0 | C~B | A | invention |
| 1-34 | (A-2).Fe | 30 | 0.1 | B | A | invention |
| 1-35 | (A-2).Fe | 10 | 0.1 | A | A | invention |
| 1-36 | (A-2).Fe | 0 | 0.2 | A | A | invention |
| 1-37 | (A-3).Fe | 100 | 0.1 | C | B | invention |
| 1-38 | (A-3).Fe | 60 | 0.1 | C | B | invention |
| 1-39 | (A-3).Fe | 50 | 0.1 | C~B | A | invention |
| 1-40 | (A-3).Fe | 30 | 0.1 | B | A | invention |
| 1-41 | (A-3).Fe | 10 | 0.2 | B | A | invention |
| 1-42 | (A-3).Fe | 0 | 0.2 | A | A | invention |

In Tables 3 and 4, EDTA.Fe means a ferric complex salt of ethylenediaminetetraacetic acid, PDTA.Fe a ferric complex salt of diethylenetriaminepentaacetic acid, NTA.Fe a ferric complex salt of nitrilotriacetic acid, (A-1).Fe a ferric complex salt of exemplified compound (A-1), (A-2).Fe a ferric complex salt of exemplified compound (A-2) and (A-3).Fe a ferric complex salt of exemplified compound (A-3).

As is apparent from Tables 3 and 4, when ferric complex salts of the organic acid of the invention are used, the amount of residual silver is small, staining at the edge portion can be minimized, and the preservability of the bleach-fixers can be improved. Further, when the proportion of ammonium ions to the total cations contained in the bleach-fixers is not more than 50 mol %, the above effects become larger; these effects become even larger when the proportion is not more than 30 mol %, and are best brought out when the proportion is not more than 10 mol %.

Example 2

In the examples to follow, addition amounts to light-sensitive material are in grams per square meter unless otherwise indicated. Amounts of silver halides and colloidal silvers are shown in silver equivalents. A silver iodobromide color photographic light-sensitive material was prepared as follows:

Preparation of Silver Iodobromide Color Photographic Light-sensitive Material

A 60-μm thick triacetyl cellulose film support was subbed on one side. Then, layers of the following compositions were formed in order on the unsubbed side (reverse side) of the support.

| | |
|---|---|
| Reverse side 1st layer | |
| Alumina Sol AS-100 (aluminium oxide made by Nissan Chemical Ind., Ltd.) | 0.8 g |
| Reverse side 2nd layer | |
| Diacetyl cellulose | 100 mg |
| Stearic acid | 10 mg |
| Silica fine particles (average particle size: 0.2 μm) | 50 mg |

Subsequently, layers of the following compositions were formed in order on the subbed side of the triacetyl cellulose film support to prepare a multilayer color photographic light-sensitive material (a-1).

| | |
|---|---|
| 1st layer: antihalation layer (HC) | |
| Black colloidal silver | 0.13 g |
| UV-absorber UV-1 | 0.20 g |
| Colored cyan coupler CC-1 | 0.02 g |
| High boiling solvent Oil-1 | 0.20 g |
| High boiling solvent Oil-2 | 0.20 g |
| Gelatin | 1.6 g |
| 2nd layer: intermediate layer (IL-1) | |
| gelatin | 1.3 g |
| 3rd layer: low-speed red-sensitive emuision layer (R-L) | |
| Silver iodobromide emulsion (average grain size: 0.3 μm) | 0.35 g |
| Silver iodobromide emulsion (average grain size: 0.4 μm) | 0.3 g |
| Sensitizing dye S-1 | $3.0 \times 10^{-4}$ mol/mol Ag |
| Sensitizing dye S-2 | $3.2 \times 10^{-4}$ mol/mol Ag |
| Sensitizing dye S-3 | $0.3 \times 10^{-4}$ mol/mol Ag |
| Cyan coupler C-1 | 0.48 g |
| Cyan coupler C-2 | 0.20 g |
| Colored cyan coupier CC-1 | 0.07 g |
| DIR compound D-1 | 0.006 g |
| DIR compound D-2 | 0.01 g |
| High boiling solvent Oil-1 | 0.55 g |
| Gelatin | 1.0 g |
| 4th layer: high-speed red-sensitive emulsion layer (R-H) | |
| Silver iodobromide emuision (average grain size: 0.7 μm) | 0.92 g |
| Sensitizing dye S-1 | $1.7 \times 10^{-4}$ mol/mol Ag |
| Sensitizing dye S-2 | $1.6 \times 10^{-4}$ mol/mol Ag |
| Sensitizing dye S-3 | $0.2 \times 10^{-4}$ mol/mol Ag |
| Cyan coupler C-2 | 0.22 g |
| Colored cyan coupler CC-1 | 0.03 g |
| DIR compound D-2 | 0.02 g |
| High boiling solvent Oil-1 | 0.30 g |
| Gelatin | 1.0 g |
| 5th layer: intermediate layer (IL-2) | |
| Gelatin | 0.8 g |
| 6th layer: low-speed green-sensitive emulsion layer (G-L) | |
| Silver iodobromide emulsion (average grain size: 0.4 μm) | 0.58 g |
| Silver iodobromide emulsion (average grain size: 0.3 μm) | 0.2 g |
| Sensitizing dye S-4 | $6.7 \times 10^{-4}$ mol/mol Ag |
| Sensitizing dye S-5 | $1.0 \times 10^{-4}$ mol/mol Ag |
| Magenta coupler M-A | 0.22 g |
| Magenta coupler M-B | 0.40 g |
| Colored magenta coupler CM-1 | 0.10 g |
| DIR compound D-3 | 0.02 g |

-continued

| | |
|---|---|
| High boiling solvent Oil-2 | 0.7 g |
| Gelatin | 1.0 g |
| 7th layer: high-speed green-sensitive emulsion layer (G-H) | |
| Silver iodobromide emulsion (average grain size: 0.7 μm) | 0.88 g |
| Sensitizing dye S-6 | $1.1 \times 10^{-4}$ mol/mol Ag |
| Sensitizing dye S-7 | $2.0 \times 10^{-4}$ mol/mol Ag |
| Sensitizing dye S-8 | $0.5 \times 10^{-4}$ mol/mol Ag |
| Magenta coupler M-A | 0.48 g |
| Magenta coupler M-B | 0.13 g |
| Colored magenta coupler CM-1 | 0.04 |
| DIR compound D-3 | 0.004 g |
| High boiling solvent Oil-2 | 0.35 g |
| Gelatin | 1.0 g |
| 8th layer: yellow filter layer (YC) | |
| Yellow colloidal silver | 0.12 g |
| Additive HS-1 | 0.07 g |
| Additive HS-2 | 0.07 g |
| Additive SC-1 | 0.12 g |
| High boiling solvent Oil-2 | 0.15 g |
| Gelatin | 0.9 g |
| 9th layer: low-speed blue-sensitive emulsion layer (B-H) | |
| Silver iodobromide emulsion (average grain size: 0.3 μm) | 0.25 g |
| Silver iodobromide emulsion (average grain size: 0.4 μm) | 0.25 g |
| Sensitizing dye S-9 | $5.8 \times 10^{-4}$ mol/mol Ag |
| Yellow coupler Y-1 | 0.71 g |
| Yellow coupler Y-2 | 0.30 g |
| DIR compound D-1 | 0.003 g |
| DIR compound D-2 | 0.006 g |
| High boiling solvent Oil-2 | 0.18 g |
| Gelatin | 1.2 g |
| 10th layer: high-speed blue-sensitive emulsion layer (B-H) | |
| Silver iodobromide emulsion (average grain size: 0.8 μm) | 0.5 g |
| Sensitizing dye S-10 | $3.0 \times 10^{-4}$ mol/mol Ag |
| Sensitizing dye S-11 | $1.2 \times 10^{-4}$ mol/mol Ag |
| Yellow coupler Y-1 | 0.18 g |
| Yellow coupler Y-2 | 0.20 g |
| High boiling solvent Oil-2 | 0.05 g |
| Gelatin | 0.9 g |
| 11th layer: 1st protective layer (PRO-1) | |
| Silver iodobromide (average grain size: 0.08 μm) | 0.3 g |
| UV-absorber UV-1 | 0.07 g |
| UV-absorber UV-2 | 0.10 g |
| Additive HS-1 | 0.2 g |
| Additive HS-2 | 0.1 g |
| High boiling solvent Oil-1 | 0.07 g |
| High boiling solvent Oi1-3 | 0.07 g |
| Gelatin | 0.85 g |
| 12th layer: 2nd protective layer (PRO-2) | |
| Compound A | 0.04 g |
| Compound B | 0.004 g |
| Polymethyl methacrylate (average particle size: 3 μm) | 0.02 g |
| 3:3:4 (weight ratio) Methyl methacrylate:ethyl methacrylate:methacrylic acid copolymer (average particle size: 3 μm) | 0.13 g |

Besides the above components, the color photographic light-sensitive material contained compounds Su-1, Su-2, viscosity modifier, hardeners H-1, H-2, stabilizer ST-1, antifoggants AF-1, AF-2 having average molecular weights of 10,000 and 1,100,000, respectively, dyes AI-1, AI-2, and compound DI-1 (9.4 mg/m$^2$).

C-1
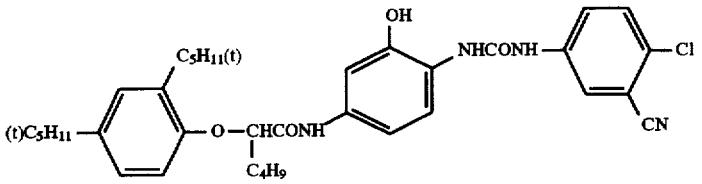
C-2
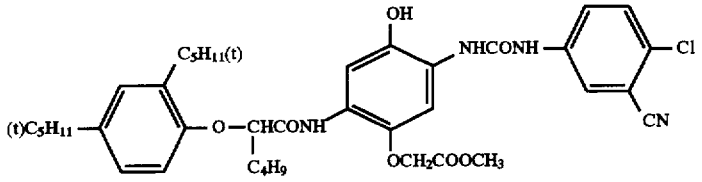
M-A
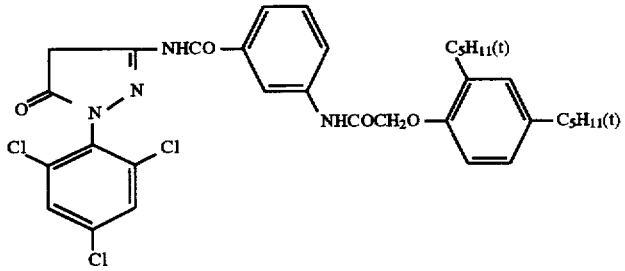
M-B
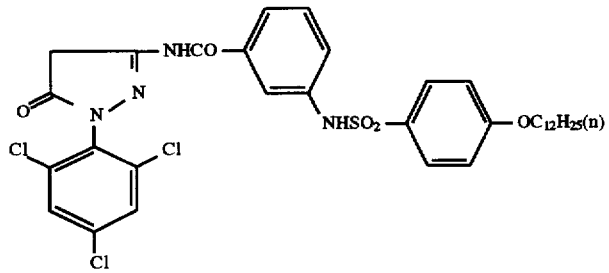
Y-1
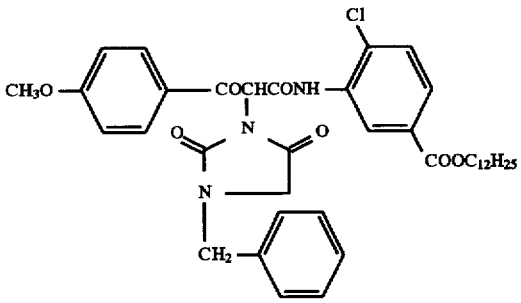
Y-2
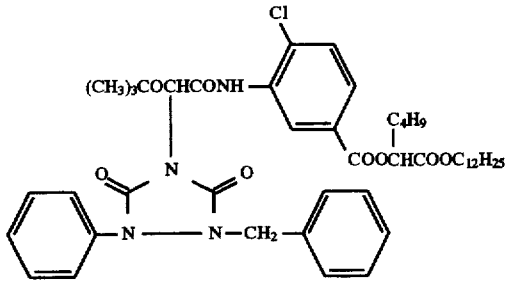

-continued
CC-1
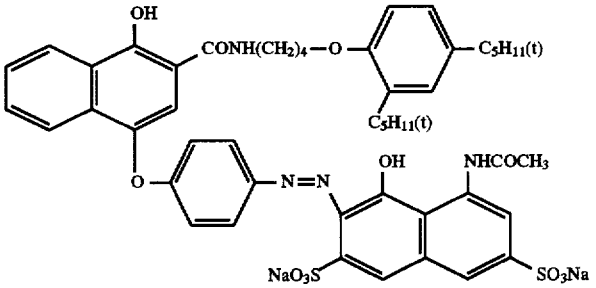
CM-1
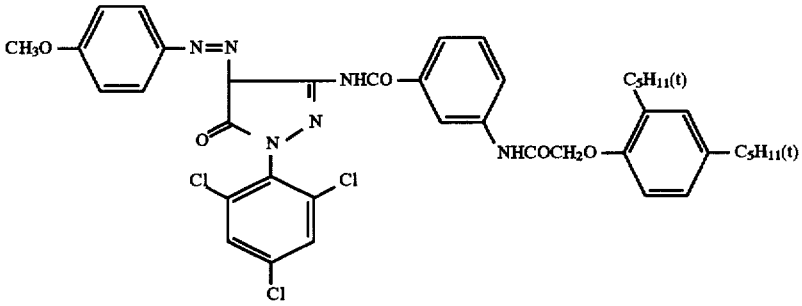
D-1
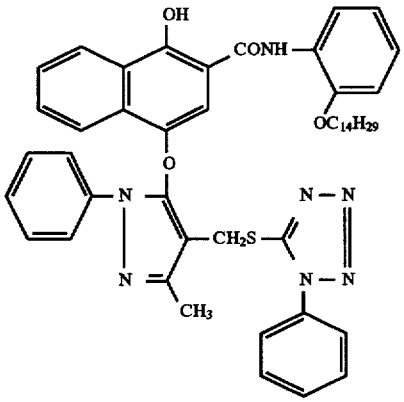
D-2
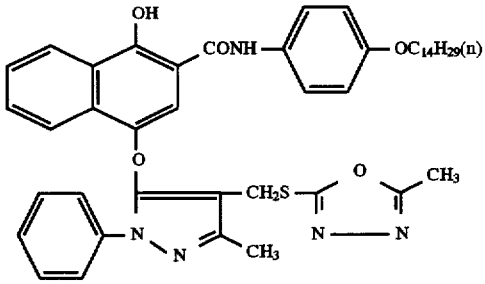

-continued
D-3
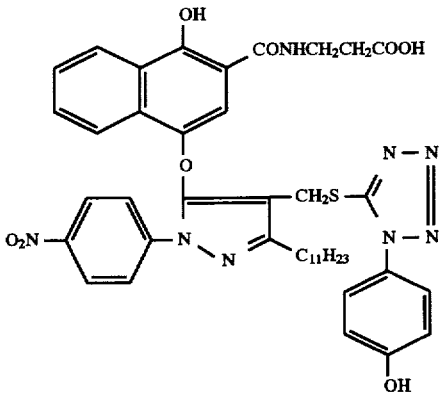
UV-1
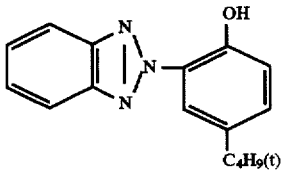
UV-2
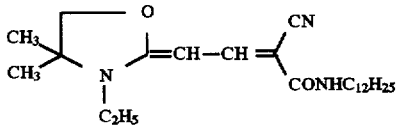
S-1
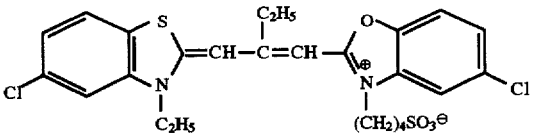
S-2
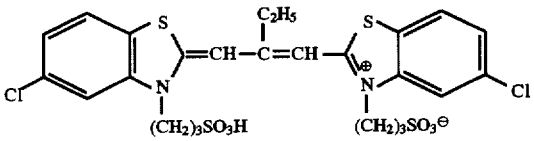
S-3
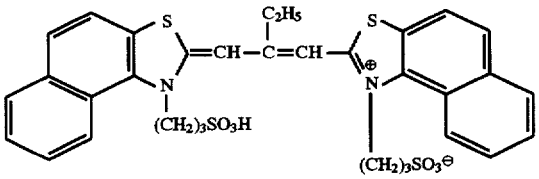
S-4
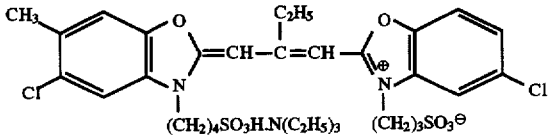
S-5
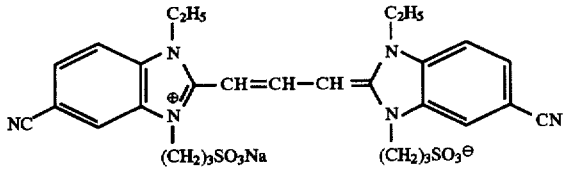
S-6
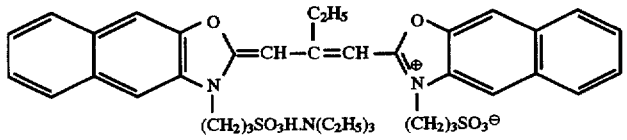

-continued
S-7
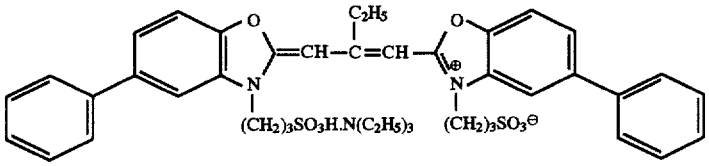
S-8
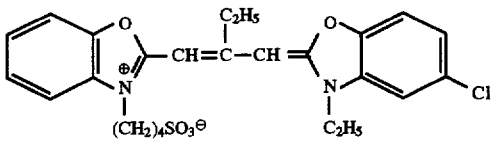
S-9
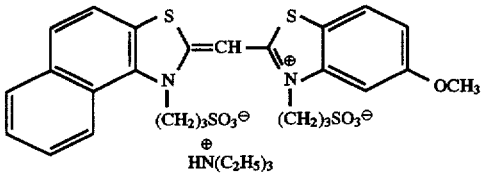
S-10
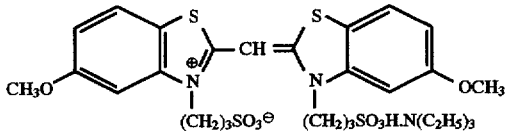
S-11
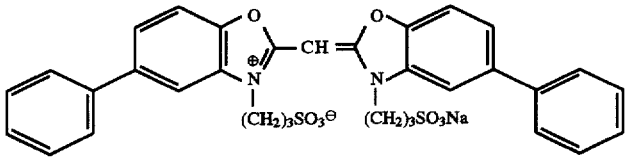
HS-1
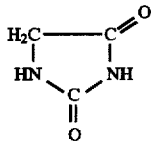
HS-2
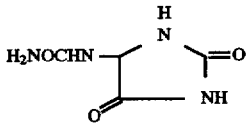
SC-1
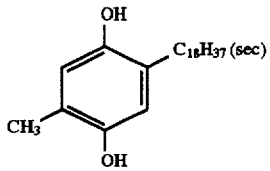
and
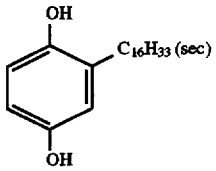
(mixture of 2:3)
Oil-1
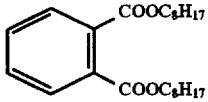
Oil-2
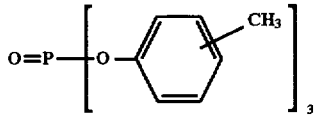
Oil-3
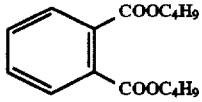

-continued
H-1
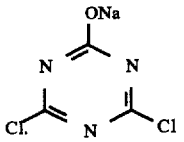
H-2
$(CH_2{=}CHSO_2CH_2)_2O$
SU-1
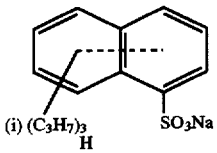
SU-2
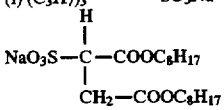
AI-1
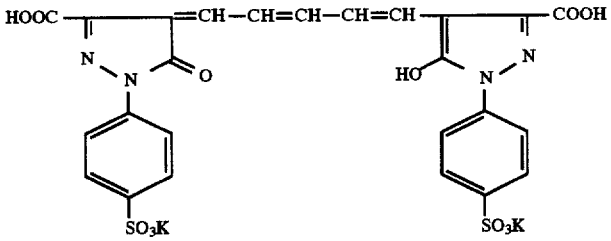
AI-2
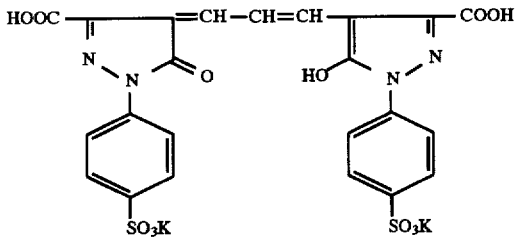
ST-1
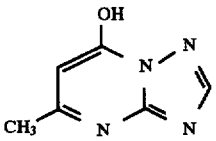
AF-1
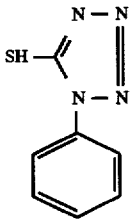
AF-2
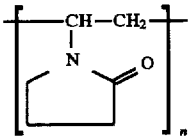
Compound A
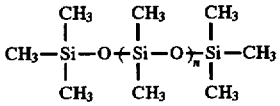
weight average molecular weight = 30000

-continued $NaO_3S-CH(CH_2-COOCH_2(CF_2CF_2)_3H)-COOCH_2(CF_2CF_2)_3H$ (mixture of the following three components)

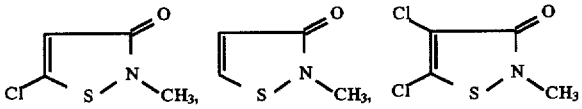

component A:component B:component C = 50:23:20

(molar ratio)

Preparation of Emulsions

The silver iodobromide emulsion used in the 10th layer was prepared by the double-jet method using monodispersed silver iodobromide grains having an average grain size of 0.33 μm and a silver iodide content of 2 mol % as seed grains; details of the procedure were as follows:

While solution G-1 was kept at 70° C., pAg 7.8 and pH 7.0, the seed emulsion was added thereto with stirring in an amount equivalent to 0.34 mol.

Formation of Internal High Iodide Content Phases or Core Phases

Subsequently, solutions H-1 and S-1 were added in 86 minutes at an accelerated flow rate (the final flow rate was 3.6 times the initial flow rate) with the flow ratio of the two solutions kept at 1:1.

Formation of External Low Silver Iodide Phases or Shell Phases

Then, while keeping the reaction liquor at pAg 10.1 and pH 6.0, solutions H-2 and S-2 were added thereto in 65 minutes at an accelerated flow rate (the final flow rate was 5.2 times the initial flow rate) with the flow ratio of the two solutions kept at 1:1.

During grain formation, the pAg and the pH were controlled with an aqueous solution of potassium bromide and 56% aqueous acetic acid. After forming grains, the grains were subjected to washing treatment according to the usual flocculation method and redispersed by adding gelatin. The resulting emulsion was adjusted to pH 5.8 and pAg 8.06 at 40° C.

The emulsion was a monodispersed emulsion comprising octahedral silver iodobromide grains having an average grain size of 0.80 μm, a coefficient of variation of grain size distribution of 12.4% and a silver iodide content of 9.0 mol %.

| | |
|---|---|
| Solution G-1 | |
| Ossein gelatin | 100.0 g |
| 10 wt % Methanol solution of compound No. 1 | 25.0 ml |
| 28% Aqueous ammonia | 440.0 ml |
| 56% Aqueous acetic acid | 650.0 ml |
| Water was added to 5000 ml | |
| Solution H-1 | |
| Ossein gelatin | 82.4 g |
| potassium bromide | 151.6 g |
| Potassium iodide | 90.6 g |
| Water was added to 1030.5 ml | |
| Solution S-1 | |
| Silver nitrate | 309.2 g |
| 28% Aqueous ammonia equivalent | |
| Water was added to 1030.5 ml | |

Compound B

DI-1

-continued

| | |
|---|---|
| Solution H-2 | |
| Ossein gelatin | 300.0 g |
| Potassium bromide | 770.0 g |
| Potassium iodide | 33.2 g |
| Water was added to 3776.8 ml | |
| Solution S-2 | |
| Silver nitrate | 1133.0 g |
| 28% Aqueous ammonia equivalent | |
| Water was added to 3776.8 ml | |

The structural formula of compound No. 1 is as follows:

The structural formula of compound No. 1 is as follows:

$$HO(CH_2CH_2O)_m(CH(CH_3)CH_2O)_{17}(CH_2CH_2O)_nH$$

(average molecular weight + 1300)

The other emulsions different in average grain size and silver iodide content were prepared in similar manners by changing the average grain size of seed grains, temperature, pAg, pH, flow rate, addition time and halide composition.

Each of the emulsions was monodispersed emulsion comprising core/shell type grains having a coefficient of variation of grain size distribution not larger than 20 mol %. Each emulsion was subjected to optimum chemical ripening in the presence of sodium thiosulfate, chloroauric acid and ammonium thiocyanate, and then sensitizing dyes, 4-hydroxy-6-methyl-1,3,3a,7-tetrazaindene and 1-phenyl-5-mercaptotetrazole were added thereto.

In using these emulsions, an adjustment was made so as to give an average silver iodide content of 8 mol % to the above silver iodobromide color photographic light-sensitive material.

The light-sensitive material sample prepared as above was exposed wedgewise by the usual method and subjected to continuous processing according to the following processes. This continuous processing was carried out till the volume of bleach-fixer replenished reached twice the capacity of the bleach-fixing tank (2R).

| Processing | Time | Temp. | Replenishing Amount |
|---|---|---|---|
| Color developing | 3 min 15 sec | 38° C. | 20 ml |
| Bleaching | 45 sec | 38° C. | 5 ml |
| Fixing | 1 min 30 sec | 38° C. | 33 ml |
| Stabilizing (3-tanks-cascade mode) | 1 min | 38° C. | 40 ml |
| Drying | 1 min | 49–80° C. | |

-continued

| Color Developer | |
|---|---|
| Potassium carbonate | 39.0 g |
| Sodium hydrogencarbonate | 2.0 g |
| Potassium sulfite | 3.0 g |
| Sodium bromide | 1.2 g |
| Potassium iodide | 1.2 mg |
| Hydroxylamine sulfate | 2.5 g |
| Sodium chloride | 0.6 g |
| Color developing agent CD-4 (4-Amino-3-methyl-N-ethyl-N-(β-hydroxylethyl) aniline sulfate) | 4.5 g |
| Diethylenetriaminepentaacetic acid | 3.0 g |
| Potassium hydroxide | 1.2 g |

Water was added to 1 liter, and the pH was adjusted to 10.00 with potassium hydroxide or 20% sulfuric acid.

| Color Developing Replenisher | |
|---|---|
| Potassium carbonate | 35.0 g |
| Sodium hydrogencarbonate | 3.0 g |
| Potassium sulfite | 5.0 g |
| Sodium bromide | 0.4 g |
| Hydroxylamine sulfate | 3.5 g |
| CD-4 | 6.0 g |
| Potassium hydroxide | 2.0 g |
| Diethylenetriaminepentaacetic acid | 3.0 g |
| Water was added to 1 liter, and the pH was adjusted to 10.15 with potassium hydroxide or 20% sulfuric acid. | |
| **Bleach** | |
| Organic acid ferric complex salt (see Tables 5 and 6) | 0.35 mol |
| Ethylenediaminetetraacetic acid | 10 g |
| Bromide salt | 1.2 mol |
| Glacial acetic acid | 40 ml |

The pH was adjusted to 4.5 with aqueous ammonia or acetic acid, and the total volume was made up to 1 liter with water.

As shown in Table 5 and 6, the proportion (mol %) of ammonium ions in the bleach was adjusted by using ammonium salts and potassium salts of the above additives in proper ratios.

Bleaching Replenisher

The components of the above bleach were each used at a concentration 1.2 times that in the bleach, and the pH was adjusted to 3.5.

| Fixer (Tank Solution and Replenisher) | |
|---|---|
| Ammonium thiosulfate (70% solution) | 350 ml |
| Anhydrous sodium bisulfite | 10 g |
| Sodium metabisulfite | 2.5 g |
| Disodium ethylenediaminetetraacetate | 0.5 g |
| **Stabilizer (Tank Solution and Replenisher)** | |
| Hexamethylenetetramine | 5 g |
| Diethylene glycol | 10 g |
| 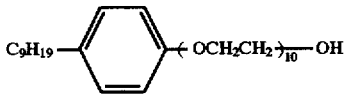 | 1 g |

The pH was adjusted to 8.0 with potassium hydroxide and water was added to 1 liter.

The continuous processing in Example 1 was repeated. Then, the magenta transmission density (green light density) in the unexposed portion of the film sample was determined and, at the same time, the amount of residual silver in the exposed portion was measured by X-ray fluorescence analysis.

The evaluation results are summarized in Tables 5 and 6.

TABLE 5

| Experiment No. | Organic Acid Ferric Complex Salt | Proprotion of Ammonium Ions to Total Cations in Bleach (mol %) | Amount of Residual Silver (mg/100 cm$^2$) | Magenta Transmission Density in Unexposed Portion | Remarks |
|---|---|---|---|---|---|
| 2-1 | EDTA.Fe | 100 | 7.3 | 0.57 | comparison |
| 2-2 | EDTA.Fe | 60 | 7.4 | 0.57 | comparison |
| 2-3 | EDTA.Fe | 50 | 7.4 | 0.57 | comparison |
| 2-4 | EDTA.Fe | 30 | 7.6 | 0.56 | comparison |
| 2-5 | EDTA.Fe | 10 | 7.8 | 0.56 | comparison |
| 2-6 | EDTA.Fe | 0 | 7.9 | 0.56 | comparison |
| 2-7 | PDTA.Fe | 100 | 0 | 0.65 | comparison |
| 2-8 | PDTA.Fe | 60 | 0 | 0.64 | comparison |
| 2-9 | PDTA.Fe | 50 | 0.1 | 0.62 | comparison |
| 2-10 | PDTA.Fe | 30 | 0.1 | 0.62 | comparison |
| 2-11 | PDTA.Fe | 10 | 0.2 | 0.61 | comparison |
| 2-12 | PDTA.Fe | 0 | 0.3 | 0.60 | comparison |
| 2-13 | DTPA.Fe | 100 | 6.5 | 0.58 | comparison |
| 2-14 | DTPA.Fe | 60 | 6.5 | 0.58 | comparison |
| 2-15 | DTPA.Fe | 50 | 6.8 | 0.57 | comparison |
| 2-16 | DTPA.Fe | 30 | 6.9 | 0.56 | comparison |
| 2-17 | DTPA.Fe | 10 | 7.0 | 0.56 | comparison |
| 2-18 | DTPA.Fe | 0 | 7.0 | 0.56 | comparison |
| 2-19 | NTA.Fe | 100 | 8.3 | 0.57 | comparison |
| 2-20 | NTA.Fe | 60 | 8.4 | 0.56 | comparison |
| 2-21 | NTA.Fe | 50 | 8.6 | 0.56 | comparison |
| 2-22 | NTA.Fe | 30 | 8.7 | 0.56 | comparison |
| 2-23 | NTA.Fe | 10 | 9.1 | 0.55 | comparison |
| 2-24 | NTA.Fe | 0 | 9.1 | 0.54 | comparison |

TABLE 6

| Experiment No. | Organic Acid Ferric Complex Salt | Proprotion of Ammonium Ions to Total Cations in Bleach (mol %) | Amount of Residual Silver (mg/100 cm$^2$) | Magenta Transmission Density in Unexposed Portion | Remarks |
|---|---|---|---|---|---|
| 2-25 | (A-1).Fe | 100 | 0 | 0.58 | invention |
| 2-26 | (A-1).Fe | 60 | 0 | 0.57 | invention |
| 2-27 | (A-1).Fe | 50 | 0 | 0.57 | invention |
| 2-28 | (A-1).Fe | 30 | 0 | 0.57 | invention |
| 2-29 | (A-1).Fe | 10 | 0.1 | 0.57 | invention |
| 2-30 | (A-1).Fe | 0 | 0.2 | 0.56 | invention |
| 2-31 | (A-2).Fe | 100 | 0 | 0.57 | invention |
| 2-32 | (A-2).Fe | 60 | 0 | 0.57 | invention |
| 2-33 | (A-2).Fe | 50 | 0 | 0.57 | invention |
| 2-34 | (A-2).Fe | 30 | 0.1 | 0.57 | invention |
| 2-35 | (A-2).Fe | 10 | 0.2 | 0.55 | invention |
| 2-36 | (A-2).Fe | 0 | 0.2 | 0.55 | invention |
| 2-37 | (A-23).Fe | 100 | 0.1 | 0.59 | invention |
| 2-38 | (A-23).Fe | 60 | 0.1 | 0.58 | invention |
| 2-39 | (A-23).Fe | 50 | 0.1 | 0.57 | invention |
| 2-40 | (A-23).Fe | 30 | 0.2 | 0.57 | invention |
| 2-41 | (A-23).Fe | 10 | 0.4 | 0.55 | invention |
| 2-42 | (A-23).Fe | 0 | 0.4 | 0.54 | invention |

It can be understood from Tables 5 and 6 that use of the organic acid ferric complex salt of the invention decreases the amount of residual silver and further retards the rise in magenta transmission density in the unexposed portion. In addition, when the proportion of ammonium ions to the total cations in the bleach is not more than 50 mol %, the above effects are well brought out. These effects become much noticeable when the proportion is not more than 30 mol % and are best brought out when the proportion is not more than 10 mol %.

Example 3

As a photographic processing solution, a color developer of the following composition was prepared.

| | |
|---|---|
| Potassium carbonate | 30.9 g |
| Sodium hydrogencarbonate | 2.5 g |
| Fotassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxylethyl)aniline sulfate | 4.5 g |
| Diethylenetriaminepentaacetic acid | 3.0 g |
| Potassium hydroxide | 1.2 g |

Water was added to 1 liter, and the pH was adjusted to 10.00 with potassium hydroxide or 20% sulfuric acid.

The above developer was designated as sample A, and a developer prepared by adding exemplified compound A-1 to sample A at a proportion of 2 g/l was designated as sample B. Similarly, one containing 2 g/l of exemplified compound A-2 was designated as sample C, one containing 2 g/l of exemplified compound A-3 as sample D, one containing 2 g/l of exemplified compound A-4 as sample E, one containing 2 g/l of exemplified compound A-23 as sample F, one containing 2 g/l of sodium hexametaphosphate (hereinafter abbreviated to HMP) as sample G, one containing 3.3 g/l of 1-hydroxyethylidene-1,1-diphosphonic acid 60% solution (HEDP) as sample H, one containing 2 g/l of ethylenediaminetetraacetic acid (EDTA) as sample I, and one containing 2 g/l of nitrilotrimethylenephosphonic acid (NTP) as sample J. Seven samples were so prepared.

Since these samples varied in pH with the compounds added thereto, their pHs were each adjusted to 10.0 with potassium hydroxide or a dilute sulfuric acid. Then, the following experiments were made, of which results are summarized in Table 7.

Experiment No. 1

To each of samples A to J were added 1.5 ppm of ferric ions and 0.5 ppm of copper ions (ferric ions and copper ions to concentrations of 1.5 ppm and 0.5 ppm, respectively). Each sample was then allowed to stand for 7 days at 35° C. followed by quantitative analysis of hydroxylamine to determine its decrement.

Experiment No. 2

The light-sensitive material used in Example 2 was exposed stepwise to white light using a sensitometer and, then, subjected to color development under the following conditions. In the color developing, developer samples A to J aged for 7 days as in Example 1 were used by turns.

| Process | Processing Time | Processing Temp. |
|---|---|---|
| Color developing | 3 min 15 sec | 38° C. |
| Bleaching | 45 sec | 38° C. |
| Fixing | 1 min 30 sec | 38° C. |
| Stabilizing | 50 sec | 38° C. |
| Drying | 1 min | 40–70° C. |

The following are compositions of the processing solutions used in the above processes except color developing:

Bleach

| | |
|---|---|
| Ammonium ferric 1,3-propylenediaminetetraacetate | 0.32 mol |
| Disodium ethylenediaminetetraacetate | 10 g |
| Ammonium bromide | 100 g |
| Glacial acetic acid | 40 g |
| Ammonium nitrate | 40 g |

Water was added to 1 liter, and the pH was adjusted to 4.4 with aqueous ammonia or glacial acetic acid.

Fixer and Stabilizer

The same processing solutions as those in Example 2 were employed.

After the color development, the fog density of blue reflection density in the unexposed portion was measured for each sample with a Konica PDA-65 photoelectric densitometer.

Experiment No. 3

After adding 210 ppm of calcium ions and 3000 ppm of sodium ions (calcium ions and sodium ions to concentrations of 10 ppm and 3000 ppm, respectively,) to each of developer samples A to J, each developer sample was allowed to stand for days at room temperature and, then, checked for precipitation.

The results of Experiments Nos. 1 to 3 are shown in Table 7.

TABLE 7

| Sample No. | Chelating Agent (2 g/l) | Experiment No.1, Decrement (%) | Experiment No.2, Fog Density | Experiment No.3, Precipitation | Remarks |
|---|---|---|---|---|---|
| (A) | none | 49 | 0.12 | D | comparison |
| (B) | exemplified compound A-1 | 15 | 0.01 | A | invention |
| (C) | exemplified compound A-2 | 13 | 0.02 | A | invention |
| (D) | exemplified compound A-3 | 16 | 0.02 | A | invention |
| (E) | exemplified compound A-6 | 17 | 0.03 | A | invention |
| (F) | exemplified compound A-23 | 17 | 0.02 | A | invention |
| (G) | HMP | 50 | 0.08 | C | comparison |
| (H) | HEDP | 32 | 0.02 | D | comparison |
| (I) | EDTA | 76 | 0.14 | A | comparison |
| (J) | NTP | 73 | 0.13 | B | comparison |

Notes: In Experiment No.3, A indicates no precipitation; B, C and D mean that the amount of precipitates formed increases in this order.

It can be understood from the table that developer samples B to F according to the invention are lower in hydroxylamine decomposition, less in fogging and less in formation of precipitates due to the metal ions added.

On the contrary, comparative sample H, though a little effective in preventing hydroxylamine decomposition and fogging, is not effective at all in preventing formation of precipitates due to metal ions present therein and impractical for use.

Comparative sample I is as effective as the chelating agent of the invention in preventing precipitation, but it accelerates decomposition of hydroxylamine and causes heavy fogs; therefore, it is also impractical for use. Further, samples A, G and J cannot be used practically, either, because these not only decompose hydroxylamine and cause fogs but are low in capability of preventing precipitation in the presence of metal ions.

Example 4

A first developer for reversal films of the following composition (black-and-white developer) was prepared as a photographic processing composition.

| | |
|---|---|
| Potassium sulfite (50% solution) | 45.0 ml |
| Sodium bromide | 2.0 g |
| Sodium thiocyanate | 1.1 g |
| Potassium iodide | 3.0 mg |
| Diethylene glycol | 20.0 ml |
| 1-Phenyl-3-pyrazolidone (trade name: Phenidone) | 0.58 g |
| Hydroquinone | 6.0 g |
| Potassium carbonate | 28.2 g |
| Potassium hydroxide | 2.8 g |
| Water was added to 1 liter. | |

The above developer was designated as sample K, and a developer prepared by adding ethylenediaminetetraacetic acid (EDTA) to sample K at a proportion of 2 g/l was designated as sample L. Similarly, one containing 2g/l of exemplified compound A-1 was designated as sample M, and one containing 2 g/l of ethylenediaminetetramethylene-phosphonic acid (EDTP) as sample N. These four samples were each adjusted to pH 9.90 with potassium hydroxide or 20% sulfuric acid.

After adding 3.0 ppm of ferric ions and 200 ppm of calcium ions (ferric ions and calcium ions to concentrations of 3.0 ppm and 200 ppm, respectively,) to each sample, each sample was kept at 35° C. for 7 days. Then, the decrement of Phenidone was quantitatively determined and the formation of precipitates was checked, of which results are shown in Table 8.

TABLE 8

| Sample No. | Chelating Agent | Decrement of Phenidone (%) | Formation of Precipitates | Remarks |
|---|---|---|---|---|
| (K) | none | 37 | D | comparison |
| (L) | EDTA | 75 | B | comparison |
| (M) | exemplified compound A-1 | 11 | A | invention |
| (N) | EDTP | 54 | B | comparison |

Notes: In the table, A indicates no formation of precipitates; B, C and D indicate that the amount of precipitates become larger in this order.

As is obvious from the above table, comparative sample L accelerates decomposition of Phenidone, a developing agent, though effective in preventing precipitation caused by metal ions.

The other comparative samples K and N are not or less effective in preventing decomposition of Phenidone and not so effective in preventing precipitation, either. On the contrary, sample M containing the chelating agent of the invention effectively inhibits formation of precipitates and well prevents decomposition of Phenidone.

Example 5

A fixer and a bleach-fixer of the following compositions were prepared as photographic processing compositions to examine the deterrent effect of the exemplified compound upon formation of precipitates due to metal ions.

| Fixer | |
|---|---|
| Ammonium thiosulfate | 200 g |
| Ammonium sulfite | 20 g |
| Potassium metabisulfite | 5 g |
| Water was added to 1 liter. | |
| **Bleach-fixer** | |
| Ammonium ferric ethylenediaminetatraacetate | 60 g |
| Ammonium sulfite (40% solution) | 20 ml |
| Ammonium thiosulfate (70% solution) | 180 ml |
| Aqueous ammnonia (28% solution) | 30 ml |
| Water was added to 1 liter. | |

The fixer and the bleach-fixer were partially used as they were for comparison. To the other portions were independently added exemplified compounds A-1, A-2, A-3 and A-23 at proportions of 4 g/l respectively, so that eight samples were prepared. Of these solutions, the fixers were adjusted to pH 6.8, and the bleach-fixers to pH 7.1, with aqueous ammonia or acetic acid. Then, 200 ppm of calcium ions were added to each solution (calcium ions were added to a concentration of 200 ppm to each solution).

When these were allowed to stand, the comparative samples containing no exemplified compound produced considerable precipitates in both the fixer and the bleach-fixer, but the samples containing exemplified compound A-1, A-2, A-3 and A-23 did not form any precipitate.

Example 6

A stabilizer of the following compositions were prepared as photographic processing compositions (also referred to as a stabilizer for non-water washing) to examine the exemplified compound's deterrent effect upon formation of floating matter caused by sulfuration.

| Stabilizer | |
|---|---|
| 5-Chloro-2-methyl-4-isothiazoline-3-one | 0.02 g |
| 2-Methyl-4-isothiazoline-3-one | 0.02 g |
| Ethylene glycol | 1.5 g |
| 2-Octyl-4-isothiazoline-3-one | 0.01 g |
| Benzotriazole | 1.2 g |
| Aqueous ammnonia (28% solution) | 3.0 ml |

Water was added to 1 liter, and the pH was adjusted to 8.0 with potassium hydroxide or 20% sulfuric acid.

This stabilizer was partially used as it was for comparison, and exemplified compounds A-1, A-2 and A-3 were independently added to the rest of the stabilizer at proportions of 3 g/l, so that three samples were prepared.

After adjusting each stabilizer to pH 8.0 with potassium hydroxide or 20% sulfuric acid, 100 ppm of calcium ions were added thereto, and each stabilizer was allowed to stand. While a floating matter was formed in 2 days on the surface of the comparative one containing no exemplified compound, the stabilizer containing exemplified compound A-1, A-2 or A-3 showed no abnormal change even in a 10-day period and prevented growth of fungi.

Example 7

Popularly used photographic chelating agents, namely ethylenediaminetetraacetic acid (EDTA), diethylenetriaminepentaacetic acid (DTPA), N-hydroxyethylethylenediaminetriacetic acid (HEDTA), as well as exemplified compounds A-1 and A-2 were tested for biodegradability according to 301C Amendment of MITI Test (I) adopted on May 12, 1981 under OECD's guideline for testing chemical substances.

In the test, relative biodegradabilities were determined by setting the degradability of exemplified compound A-1 as 100. The results obtained are shown in Table 9.

TABLE 9

| Chelating Agent | Biodegradability (%) |
|---|---|
| EDTA | 2 |
| DTPA | 1 |
| HEDTA | 4 |
| Exemplified compound A-1 | 100 |
| Exemplified compound A-2 | 96 |
| Exemplified compound A-3 | 97 |

As is apparent from Table 9, the chelating agents of the invention are excellent in biodegradability in contrast with EDTA, DTPA and HEDTA which can be hardly degraded; therefore, it can be understood that the chelating agent of the invention are well fit for global environmental protection.

What is claimed is:

1. A process for processing a silver halide photographic light-sensitive material, comprising the steps of:

exposing the material;

developing the exposed material with a developer; and bleaching or bleach-fixing the developed material with a solution containing a ferric complex salt of a compound represented by the following Formula (A):

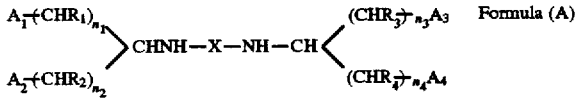

Formula (A)

wherein $A_1$, $A_2$, $A_3$ and $A_4$ each represent —$COOM_1$, —$OH_1$, —$PO_3M_1M_2$ or —$CONH_2$ in which $M_1$ and $M_2$ each represent a hydrogen ion, an alkali metal ion or another cation, $R_1$, $R_2$, $R_3$ and $R_4$ each represent a hydrogen atom, a methyl group or a hydroxyl group; $n_1$, $n_2$, $n_3$ and $n_4$ each represent an integer of 0, 1 or 2, provided that none of $R_1$, $R_2$, $R_3$ and $R_4$ are hydrogen atoms when $n_1+n_2=1$ and $n_3+n_4=1$; and X represents a substituted or unsubstituted alkylene group having 2 to 6 carbon atoms or —$(B_1O)m$-$B_2$— in which $B_1$ and $B_2$ each represent a substituted or unsubstituted alkylene group having 1 to 5 carbon atoms, and m is an integer of from 1 to 4; and further provided that when $n_1=n_3=0$ and $n_2=n_4=1$, or $n_1=n_3=1$ and $n_2=n_4=0$, said compound represented by said Formula (A) does not consist essentially of an optical isomer about the carbon atoms to which the nitrogen atoms are directly bonded.

2. The process of claim 1, wherein said $n_1$ and $n_3$ each represent 0, provided that none of $R_2$ and $R_4$ are hydrogen atoms when $n_2=1$ and $n_4=1$; and X represents an ethylene, trimethylene or tetramethylene group or —$(B_1O)_m$-$B_2$— in which $B_1$ and $B_2$ each represent a methylene, ethylene or trimethylene group and m is an integer of 1 or 2.

3. The process of claim 1, wherein said compound is at least one selected from the group consisting of the following Formulae A-1, A-2, A-4 and A-23:

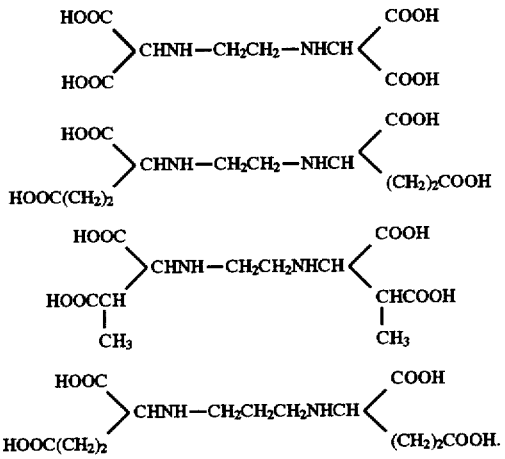

A-1

A-2

A-4

A-23

4. The process of claim 1, wherein said solution further contains ammonium ion in an amount of not more than 50 mol % based on the total cation content.

5. A process for processing a silver halide photograhic light-sensitive material, comprising the steps of:

exposing the material;

developing the exposed material with a developer;

bleaching or bleach fixing the developed material with a bleach or bleach-fixer;

fixing the bleached or bleach-fixed material with a fixer; and stabilizing the fixed material with a stabilizer, wherein said developer, said fixer or said stabilizer contains a compound represented by the following Formula (A):

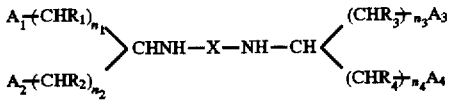

Formula (A)

wherein $A_1$, $A_2$, $A_3$ and $A_4$ each represent $—COOM_1$, —OH, $—PO_3M_1M_2$ or $—CONH_2$ in which $M_1$ and $M_2$ each represent a hydrogen ion, an alkali metal ion or another cation; $R_1$, $R_2$, $R_3$ and $R_4$ each represent a hydrogen atom, a methyl group or a hydroxyl group; $n_1$, $n_2$, $n_3$ and $n_4$ each represent an integer of 0, 1 or 2, provided that none of $R_1$, $R_2$, $R_3$ and $R_4$ are hydrogen atoms when $n_1+n_2=1$ and $n_3+n_4=1$; and X represents a substituted or unsubstituted alkylene group having 2 to 6 carbon atoms or $—(B_1O)m-B_2—$ in which $B_1$ and $B_2$ each represent a substituted or unsubstituted alkylene group having 1 to 5 carbon atoms, and m is an integer of 1 to 4; and further provided that when $n_1=n_3=0$ and $n_2=n_4=1$, or $n_1=n_3=1$ and $n_2=n_4=0$, said compound represented by said Formula (A) does not consist essentially of an optical isomer about the carbon atoms to which the nitrogen atoms are directly bonded.

6. The process of claim 5, wherein said $n_1$ and $n_3$ each represent 0, provided that none of $R_2$ and $R_4$ are hydrogen atoms when $n_2=1$ and $n_4=1$; and X represents an ethylene, trimethylene or tetramethylene group or $—(B_1O)m-B_2—$ in which $B_1$ and $B_2$ each represent a methylene, ethylene or trimethylene group and m is an integer of 1 or 2.

7. The process of claim 5, wherein said compound is at least one selected from the group consisting of the following Formulae A-1, A-2, A-4 and A-23:

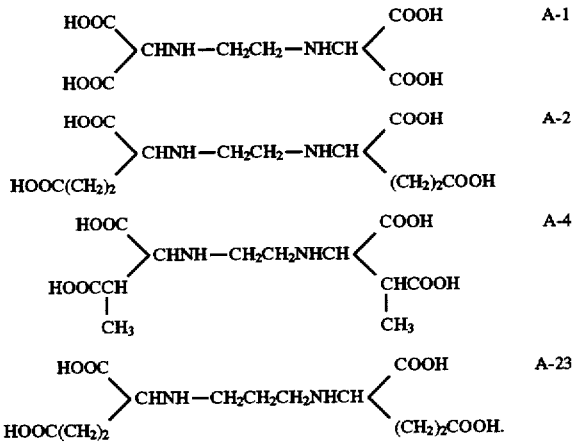

A-1

A-2

A-4

A-23

* * * * *